US005807187A

United States Patent [19]

Hamm

[11] Patent Number: 5,807,187

[45] Date of Patent: Sep. 15, 1998

[54] AIR CHANNELING GOLF CLUB HEAD

[75] Inventor: Jack L. Hamm, Englewood, Colo.

[73] Assignee: LongBall Sports, Englewood, Colo.

[21] Appl. No.: 731,845

[22] Filed: Oct. 21, 1996

Related U.S. Application Data

[60] Provisional application No. 60/006,057 Oct. 24, 1995.

[51] Int. Cl. [6] ..... A63B 53/04

[52] U.S. Cl. ..... 473/327; 473/345

[58] Field of Search ..... 473/324, 327, 473/219, 228, 345, 350, 224, 234

[56] References Cited

U.S. PATENT DOCUMENTS

| | | |
|---|---|---|
| 780,766 | 1/1905 | Brown . |
| 922,444 | 5/1909 | Youds . |
| 1,336,671 | 4/1920 | Backus . |
| 1,414,124 | 4/1922 | Griffin . |
| 1,549,350 | 8/1925 | Deike . |
| 1,697,846 | 1/1929 | Anderson . |
| 3,468,544 | 9/1969 | Antonious . |
| 3,794,328 | 2/1974 | Gordon . |
| 3,819,180 | 6/1974 | Murphy . |
| 4,065,133 | 12/1977 | Gordos . |
| 4,809,982 | 3/1989 | Kobayashi . |
| 4,869,508 | 9/1989 | Miller . |
| 5,054,784 | 10/1991 | Collins . |
| 5,158,296 | 10/1992 | Lee . |
| 5,529,303 | 6/1996 | Chen ..... 473/327 |

FOREIGN PATENT DOCUMENTS

| | | |
|---|---|---|
| 642134 | 6/1962 | Canada . |
| 312761 | 6/1929 | United Kingdom . |
| 322635 | 12/1929 | United Kingdom . |
| 854249 | 11/1960 | United Kingdom . |

*Primary Examiner*—Sebastiano Passaniti
*Attorney, Agent, or Firm*—Swanson & Bratschun LLC

[57] ABSTRACT

A golf club head having a body having a ball impacting face, a club shaft receiving socket and a tail extending rearwardly from the ball impacting face. The body has at least one air passage extending between the ball impacting face and the tail to channel air through the ball impacting face and out the tail as the club head is swung with the ball impacting face leading.

7 Claims, 1 Drawing Sheet

AIR CHANNELING GOLF CLUB HEAD

This application claims the benefit of U.S. Provisional Application Ser. No. 60/006,057 filing date Oct. 24, 1995.

BACKGROUND OF THE INVENTION

1. Technical Field

The present invention is directed toward golf club heads, and more particularly toward a golf club head with a perforated face.

2. Background Art

Conventional golf club heads feature a ball impacting face and a tail which extends rearwardly from the ball impacting face. The ball impacting face is inclined somewhat from vertical with the club head in a ball impacting position, with the degree of inclination varying depending upon whether the club is intended for long distances (such as low numbered woods and irons) or shorter distances (such as higher numbered wood and irons). As the club number increases, the degree of inclination from vertical also increases. One incidental result of this necessary design feature of club heads is that the club heads intended for driving the ball the longest distance are actually the least aerodynamic because they have the most vertical ball impacting faces. In addition, conventional clubs, particularly woods, feature smooth tail surfaces. While these smooth surfaces do not significantly impair the aerodynamics of the club head, they do nothing to aid club head stability as the club head is swung. One attempt to improve club head stability has been to include channeling grooves in the top of the club head. One example of such a club head is the 17-4PH™ distributed by LongBall Sports, Inc. of Englewood, Colo. While these channeling grooves have been found to improve club head stability during the swing, they do nothing to improve the inherently non-aerodynamic club face of low numbered woods and irons.

SUMMARY OF THE INVENTION

The present invention is a golf club head comprising a body having a ball impacting face, a club shaft receiving socket and a tail extending rearwardly from the ball impacting face. The body has at least one air passage extending between the ball impacting face and the tail to channel air through the ball impacting face and out the tail as the club head is swung with the ball impacting face leading. In a preferred embodiment the body is hollow and includes a body interior. A plurality of inlet holes are provided in the ball impacting surface symmetric about a central point and at least one outlet hole is provided in the tail in fluid communication with the inlet holes. Preferably the ball impacting face has a sweet spot with a known center and the central point is the known center of the sweet spot. In a highly preferred embodiment the inlet holes are at the vertexes of a hexagon surrounding the known center of the sweet spot and the outlet hole is coaxial with the known center of the sweet spot.

The air channeling golf club head of the present invention greatly reduces air drag as the club head is swung. This produces a greater club head speed for a given swing which in turn results in longer distance drives. In addition, the inlet holes in the ball impacting face combined with the outlet hole in the club head tail channel air through the club head as the club head is swung which stabilizes the club head and helps align the club head in an ideal ball striking position. As a result, the air channeling golf club head improves shot making accuracy. These advantages result from a golf club that can be made using fabricating techniques substantially identical to those presently used in manufacturing conventional golf club heads, thereby producing the aforementioned advantages at a competitive price.

A further advantage of the club head of the present invention is that a throaty whistle is emitted as the golf club head is swung in a back swing at greater than a select speed. This whistle provides an indication to the club user that his or her back-swing is too fast which is known among golfing instructors to detrimentally effect a player's swing.

DETAILED DESCRIPTION OF THE PREFERRED EMBODIMENT

Figure 1:
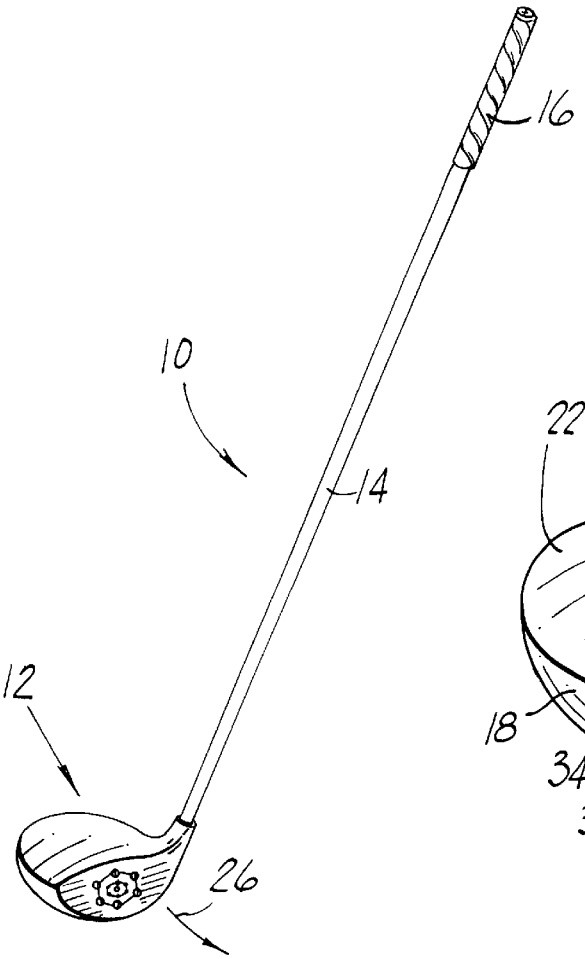
FIG. 1 is a perspective view of a golf club including the air channeling golf club head of the present invention.

FIG. 1 is a perspective view of golf club 10 including the air channeling club head 12 of the present invention. In addition to the club head 12, the club 10 includes a shaft 14 and a grip 16. The shaft may be made of any number of materials known in the golf club art, including steel and graphite.

Figure 2:
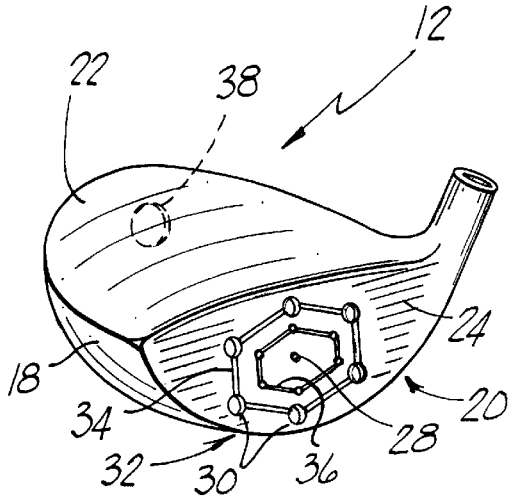
FIG. 2 is an enlarged perspective view of the air channeling golf club head of FIG. 1.

The air channeling club head 12 is shown in an enlarged perspective view in FIG. 2. The air channeling club head 12 includes a body 18 having a ball impacting surface or face 20 and a rearwardly extending tail 22. In the preferred embodiment illustrated in FIG. 2, the body 18 is hollow. The ball impacting surface 20 includes a plurality of horizontal grooves 24.

As the club head 12 is swung in the direction of the arrow 26 of FIG. 1, it has a center of gravity relative to the direction of travel at 28. The area in proximity to this center of gravity 28 is the club head's sweet spot. Disposed symmetrically around the center of gravity or center of the sweet spot 28 are a plurality of air inlets 30 in the ball striking surface. In a preferred embodiment disclosed herein, there are provided six air inlets 30 disposed at the vertexes of a hexagon 32 having the center of the sweet spot 28 at its center. In the embodiment illustrated herein grooves 34 are provided between adjacent air inlets 30, although these grooves could be omitted. The preferred embodiment also includes an inner hexagon 36 formed by connecting grooves symmetric about the center of the sweet spot 28.

Figure 3:
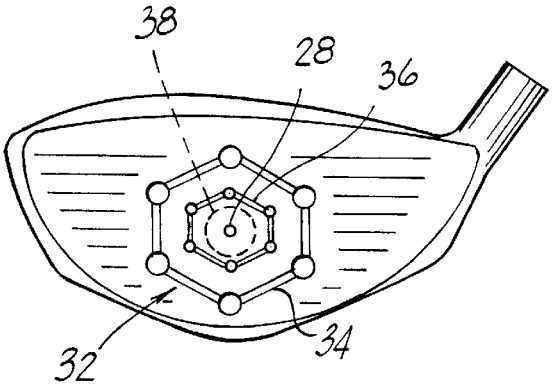
FIG. 3 is a front elevational view of the air channeling golf club head of FIG. 1.
Figure 4:
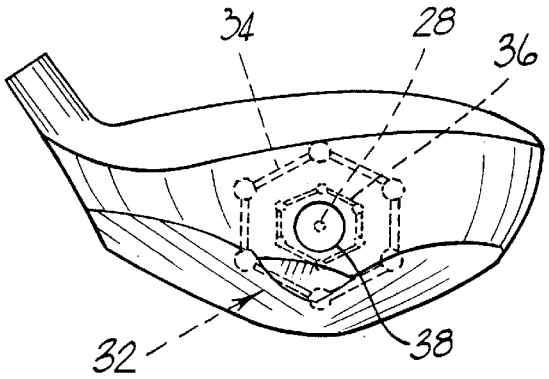
FIG. 4 is a rear elevational view of the air channeling golf club head of FIG. 1.

Opposite the ball impacting surface 20 at the back of the tail 22 is an air outlet hole 38. As seen in FIGS. 3 and 4, the air outlet hole 38 is positioned to be coaxial with the center of the sweet spot 28 and the hexagon 32.

The inlet holes 30 and the outlet 38 are aligned as described above to channel air through the hollow body 18 in a manner which decreases wind drag of the club face or the ball impacting surface 20 as the club is swung by a user. The symmetric placement of the holes stabilizes the club head so that it is directed toward the ideal ball striking position at ball impact.

The embodiment depicted in the attached figures contemplates the body 18 being hollow. This same principle could be applied if the body 18 is solid, so long as bores corresponding to the air inlets 30 are provided through the solid body to the tail. For example, an "iron" club head includes a plurality of air inlets that pass directly through the club head 50 and do not connect to a common air outlet hole 38 as do in the air inlets 30 of FIGS. 1–4. Like the embodiments of FIGS. 1–4, the air inlets of the iron act to channel air and to decrease the air drags as the club head is swung through the air.

An additional benefit of the club head 12 of the present invention is that as a golfer moves the club in a direction opposite the arrow 26 during a back swing air enters the outlet 38. If the club head moves in this direction at greater than a select speed, the air moving into the outlet hole 38 causes a whistle. Thus, this club head configuration provides an audible indication when a golfer is taking his or her back-swing too fast.

In the preferred embodiment the thickness of the ball impacting surface is increased over that of conventional golf club heads in order to add rigidity to the ball impacting surface. A typical ball impacting surface is on the order of 2 mm thick whereas the ball impacting surface of the present invention is on the order of 3.8 mm inches thick.

What is claimed is:

1. A golf club head comprising a body having a ball impacting face with a sweet spot having a known center and a tail extending rearwardly from the ball impacting face defining a hollow body interior, the body further comprising a club shaft receiving socket and a plurality of inlet holes opening into the body interior in the ball impacting surface symmetric about the known center of the sweet spot and at least one outlet hole opening into the body interior in the tail to channel air through the ball impacting face and out the tail as the club head is swung with the ball impacting face leading.

2. The golf club head of claim 1 wherein the inlet holes are at the vertices of a hexagon surrounding the known center of the sweet spot.

3. The golf club head of claim 2 having a single outlet hole, the outlet hole being coaxial with the known center of the sweet spot.

4. A golf club comprising:

a golf head body having a ball impacting face and a tail extending rearwardly from the ball impacting face defining a hollow body interior, the body further comprising a socket receiving a golf shaft and a plurality of inlet holes symmetric about a central point of the ball impacting faces; at least one inlet hole extending between the ball impacting face and the body interior and at least one outlet hole extending between the trail and the body interior; the outlet hole, body interior and inlet hole being dimensioned to emit an audible whistle when the club head is swung by the shaft in a rearward direction at greater than a select speed.

5. The golf club of claim 4 wherein the ball impacting face has a sweet spot with a known center and the central point is the known center of the sweet spot.

6. The golf club of claim 5 wherein the inlet holes are at the vertices of a hexagon surrounding the known center of the sweet spot.

7. The golf club of claim 6 having a single outlet hole, the outlet hole being coaxial with the known center of the sweet spot.

* * * * *